US007975767B2

(12) United States Patent
Purkis

(10) Patent No.: US 7,975,767 B2
(45) Date of Patent: Jul. 12, 2011

(54) APPARATUS FOR CONTROLLING A DOWNHOLE DEVICE

(75) Inventor: Daniel Purkis, Cruden Bay (GB)

(73) Assignee: Petrowell Limited, Abereen (GB)

( * ) Notice: Subject to any disclaimer, the term of this patent is extended or adjusted under 35 U.S.C. 154(b) by 485 days.

(21) Appl. No.: 11/919,962

(22) PCT Filed: May 12, 2006

(86) PCT No.: PCT/GB2006/001750
§ 371 (c)(1),
(2), (4) Date: Dec. 10, 2007

(87) PCT Pub. No.: WO2006/120466
PCT Pub. Date: Nov. 16, 2006

(65) Prior Publication Data

US 2009/0065214 A1 Mar. 12, 2009

(30) Foreign Application Priority Data

May 13, 2005 (GB) ..... 0509800.9

(51) Int. Cl.
*E21B 34/10* (2006.01)

(52) U.S. Cl. ..... 166/323; 166/373; 166/381; 166/320; 166/332.1; 166/240; 251/297

(58) Field of Classification Search ..... 166/373, 166/381, 319, 320, 323, 332.1, 237, 240; 251/297
See application file for complete search history.

(56) References Cited

U.S. PATENT DOCUMENTS

| | | | | |
|---|---|---|---|---|
| 2,853,265 | A | 8/1955 | Clark, Jr. | |
| 3,355,142 | A | 11/1967 | Kammerer, Jr. et al. | |
| 3,963,076 | A | 6/1976 | Winslow | |
| 5,156,207 | A * | 10/1992 | Haugen et al. | 166/142 |
| 6,722,439 | B2 * | 4/2004 | Garay et al. | 166/373 |
| 6,782,952 | B2 * | 8/2004 | Garay et al. | 166/374 |
| 2001/0045290 | A1 * | 11/2001 | Pringle et al. | 166/386 |
| 2002/0129942 | A1 | 9/2002 | Wetzel et al. | |

* cited by examiner

*Primary Examiner* — Jennifer H Gay
*Assistant Examiner* — Elizabeth C Gottlieb
(74) *Attorney, Agent, or Firm* — Drinker Biddle & Reath LLP

(57) ABSTRACT

Apparatus for controlling a downhole device such as a choke, the apparatus comprising a housing, a mandrel connected to the downhole device and moveable within the housing to move the device between different positions, and a detent mechanism to selectively lock the mandrel in one of the positions within the housing. The first and second positions are typically defined by physical stops on the apparatus such as shoulders, or dogs and grooves etc, and are typically placed at set positions that define the different configurations of the device. Thus, the movement of the downhole device is governed by the detent mechanism, rather than by variable factors such as pressure changes.

17 Claims, 11 Drawing Sheets

APPARATUS FOR CONTROLLING A DOWNHOLE DEVICE

RELATED APPLICATION

This Application is the U.S. National Phase Application of PCT International Application No PCT/GB2006/001750 filed May 12, 2006.

FIELD OF THE INVENTION

The invention relates to an apparatus for actuating a downhole device, particularly but not exclusively an apparatus for actuating a choke.

DESCRIPTION OF THE RELATED ART

Downhole chokes are commonly used in oil and gas wells to control the flow of production fluids from different parts of the production zone. The production fluids spread throughout a production zone are generally not of a consistent quality and quantity throughout the zone, and at certain depths of the well, there can be differences in production fluid pressures and flow rates, proportion of usable hydrocarbons to contaminating water, and the local concentration of undesirable agents such as waxes and corrosive gases etc. For this reason, it is desirable to be able to control or "choke" the flow of production fluids from the various production zones that are exposed or perforated, so that if the production fluids from one particular part of the zone are very low in usable hydrocarbons and high in contaminating water or hydrogen sulphide, for example, the flow from that particular part can be choked back to favour flow from other more productive areas. The apparatus for controlling this flow is conventionally called a choke and generally comprises a housing and a sleeve that are axially slidable with respect to one another in order to uncover apertures (in one or the other, or both) to admit the production fluids into the bore of the production tubing. As the sliding sleeve moves axially within the outer housing, more apertures become exposed, thereby varying the flow rate of production fluids into the bore of the production tubing. Similarly, a choke can be used to control fluids during injection operations. In injection mode, different zones have varying injectivity indices making it necessary to choke back injection into those zones that can be injected into most easily in favour of those with the most resistance to injection.

Conventionally hydraulic piston systems are used for moving the chokes from a closed position, where the apertures are occluded, to the open position, where the apertures are exposed to admit the production fluids. Typically, each hydraulic piston actuator has two control lines. One control line actuates the choke by pressurizing one side of the piston more than the other and the other closes the choke by operating in reverse. Slightly more sophisticated systems deliver a metered volume of fluid into the cylinder in order to try to move the piston a defined distance corresponding to the metered volume of fluid, so that intermediate positions of the choke can be selected, but there are various difficulties with this approach. Particularly, control lines reaching from the surface to the production zone can be tens of thousands of feet long, and can contain many tens of litres of hydraulic fluid. The metered volume of fluid injected at the surface to pressurise the valve and move it to an intermediate position might be of the order of a few hundred milliliters, so the signal to switch the choke to an intermediate position might be only a very small percentage increase in the pressure. This makes it difficult to reliably select multiple intermediate positions of the choke.

Other systems meter fluid into the piston chamber using a down hole metering device located at the choke itself. However, problems arise due to leaking check valves and clogged fluid restrictors caused by the prevalence of particulate contamination in the hydraulic fluid. This can be controlled to a certain extent by filters etc, but eventually, the particular matter leads to a seepage of hydraulic fluid and consequent independent movement of the choke even in the absence of a deliberate signal. Similar problems with the delivery of precise pressure changes are exacerbated by local variations in temperature, depth, pressure and other variable factors, which may affect the viscosity and volume of the hydraulic fluid, and the frictional forces involved in actuation.

BRIEF SUMMARY OF THE INVENTION

Apparatus for controlling a downhole device, the apparatus comprising a housing, a mandrel connected to the downhole device and moveable within the housing between a first position in which the downhole device adopts a first configuration and a second position in which the downhole device adopts a second configuration; and a detent mechanism interacting with the mandrel to selectively lock the mandrel in one of the first and second positions within the housing.

The first and second positions are typically defined by physical stops on the apparatus such as shoulders, or dogs and grooves etc, and are typically placed at set positions that define the configurations of the device. Thus, the range of movement of the mandrel is typically governed by the detent mechanism.

Typically, the detent mechanism is actuable to permit movement of the mandrel from the first to the second position. Typically, once the mandrel is moved to the second position it is locked in that position until the detent mechanism is actuated once more to move the mandrel. When actuated, the mandrel is typically permitted to move only in one direction by the detent mechanism.

The first and second positions can be axially spaced from one another.

Typically, the downhole device can be a sliding sleeve valve, such as a choke. The mandrel can comprise a sleeve or a shaft connected to the device, and arranged for axial movement in the borehole.

It will be understood that while certain embodiments of the invention are very suitable for actuating downhole chokes, the invention can be applied to many other downhole devices, particularly those involving axial movement in order to activate or control them. Thus, the scope of the invention is not limited to choke actuators.

Typically, the mandrel is moveable within the housing between more than two positions, for example, three, four, five or six positions, each of which define a different setting or configuration of the device. The different positions may be sequential graduated degrees of opening of a choke. For example, the first position of the mandrel may close the choke completely, the second position may be 30% open; the third position might be 50% open; the fourth position might be 70% open; the fifth position might be 90% open; and the sixth position might be fully open. The degree of opening of the choke as a result of movement of the mandrel between adjacent positions can be the same for each transition, or can be different. In some embodiments of the invention, it is desirable to have a consistent degree of opening of the choke for each transition between adjacent positions, so that for example, each transition moves the choke by the same amount. However, in other embodiments, it can be desirable to gradually reduce the movement of the choke in later transitions as compared with earlier transitions. In such embodiments, the first transition, from the first to the second position, can open the choke by e.g. 40%, whereas the last transition, for example between the fifth and the sixth positions can involve only a 10% change in the position of the choke. Therefore, such embodiments permit fine control of the motion of the choke at the end of the range of movement. In certain embodiments, the fine control can be provided at the initial transitions rather than at the later transitions.

The mandrel is typically moved by a shuttle device, typically activated by a pressure differential. The shuttle device typically has a defined range of movement independent of the position of the mandrel. The shuttle device is typically axially movable relative to the mandrel and can engage the mandrel at a certain point to move the mandrel axially with the shuttle device.

Typically, the detent mechanism comprises a locking means that is moveable relative to the mandrel. The locking means typically restricts the movement of the mandrel when the mandrel is disengaged from the shuttle device. Activation of the locking means is optionally controlled by the movement of the shuttle device. In certain embodiments, the movement of the shuttle device can cause movement of the mandrel from the first to the second position, relative to the locking means, and can optionally (and simultaneously) activate or deactivate the locking means to lock the mandrel in a different position. The locking means can then hold the mandrel in the new position while the shuttle device returns to its initial position for another cycle.

Typically, the shuttle device comprises a shuttle sleeve that interacts with the locking means in order to permit locking and unlocking of the locking means relative to the mandrel.

The mandrel can comprise a sleeve slidable within the housing and connected to the choke at one end. The mandrel sleeve can optionally have grooves or slots therein in order to interact with a locking sleeve of the locking means. The locking sleeve typically has a bore in which the mandrel sleeve is disposed and typically carries a dog or some similar device that engages within the grooves or slots on the outer surface of the mandrel sleeve. The dogs on the locking sleeve can be actuated by the movement of the shuttle device. In a first locked position of the shuttle device relative to the mandrel sleeve, the dogs are restrained within the grooves of the mandrel sleeve, typically by the shuttle sleeve moving over the locking sleeve and receiving the locking sleeve within the bore thereof, so that the dogs etc. are forced radially inwards to press against the grooves or slots on the outer surface of the mandrel sleeve.

Typically, the shuttle sleeve can also adopt a second release position in which the dogs on the locking sleeve are permitted to move out of engagement with the mandrel sleeve, so that the mandrel sleeve can move relative to the locking sleeve between first and second positions. Normally the shuttle sleeve is retracted so that the locking sleeve is no longer disposed in the bore of the shuttle sleeve, and the dogs can move radially outwards, free of the mandrel sleeve.

The movement of the shuttle sleeve by pressure differences between the lock and release positions in order to move the dogs into and out of engagement with the mandrel sleeve means that the pressure differences need only actuate the movement of the shuttle sleeve and that the extent of movement can be defined by the positioning of the grooves in the mandrel sleeve. Therefore, the pressure differences applied to move the shuttle sleeve are less sensitive to the variable factors that affect the performance of conventional systems. The dogs can be captive on the locking sleeve in slots or apertures therein and in certain embodiments can comprise ball bearings, although in some embodiments, generally flat-faced dogs housed in generally flat-sided apertures can present a more consistent planar bearing surface to the grooves on the mandrel sleeve.

The lengths of the grooves (and typically the distance from the start of one groove to the start of the adjacent groove) can optionally define the extent of movement of the choke in each transition and can be varied in any manner desired without affecting pressure differentials, since the same pressure differential can be used to actuate the shuttle sleeve for each transition.

Typically, the locking sleeve is biased by a spring means, so that it is returned to its locked position at the end of each transition.

It will be understood that while many of the embodiments operate using sleeves such as the locking sleeve, shuttle sleeve, mandrel sleeve etc, the precise form of the locking device, shuttle and choke actuator is not limited only to sleeves and other forms can be used, such as rods, bars, strips etc.

The apparatus may also have a "close" control line that overrides the interaction of the detent mechanism with the mandrel and returns the device back to its original configuration at the end of the last transition.

One embodiment of the invention provides apparatus for actuating a downhole device, the apparatus comprising a housing, a mandrel connected to the device and moveable within the housing between at least two stops to change the configuration of the downhole device; detent mechanism interacting with the mandrel to selectively lock the mandrel at one of the stops within the housing, and having a shuttle device to disengage the detent mechanism from the mandrel.

Typically, the shuttle device disengages the locking means to permit movement of the mandrel from the first position, and re-engages them after movement of the mandrel to the second position. Optionally the shuttle device also moves the mandrel.

BRIEF DESCRIPTION OF THE SEVERAL VIEWS OF THE DRAWINGS

An embodiment of the invention will now be described by way of example, with reference to the accompanying drawings, in which.

DETAILED DESCRIPTION OF THE INVENTION

Figure 1A:
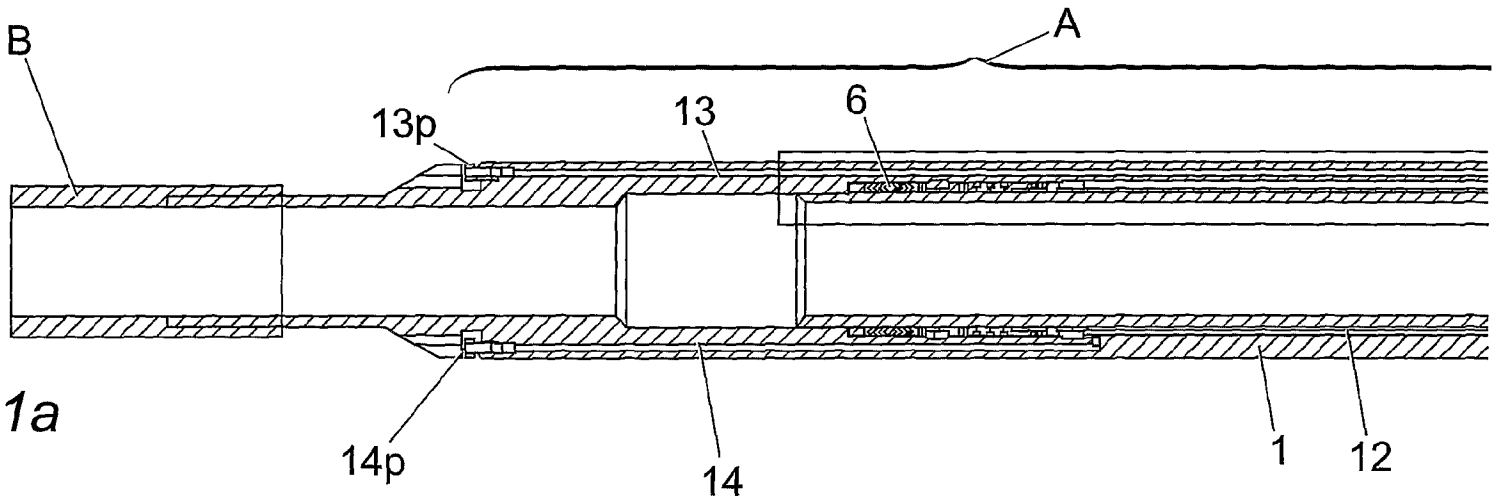
FIGS. 1*a, b* shows a side sectional view of an upper and lower end of apparatus according to the invention.
Figure 1B:
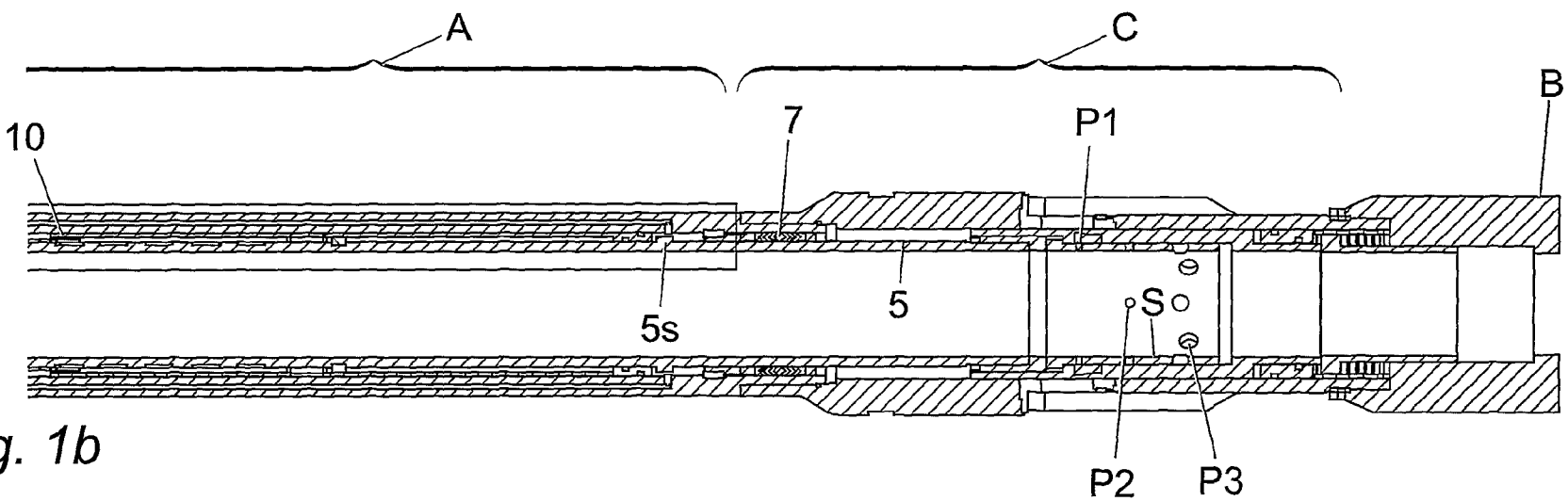

Referring now to the drawings, apparatus for actuating a downhole device is shown incorporated into a choke sub shown in FIG. 1. The downhole device being actuated by this embodiment is a choke, adapted to be opened and closed in order to control the flow of production fluids from a payzone into production tubing for recovery from an oil well.

The choke sub has a tubing adapter B, B' at each end in order to connect the sub to a string of production tubing, and is generally deployed in production tubing located in a reservoir payzone. The choke sub is divided into a choke component C, and an actuator A. The choke C is of conventional design, having an outer housing with apertures to admit production fluids into the bore of the choke, and a choke body S, having sequential rows of apertures, P1, P2, P3, which are gradually exposed to the apertures in the outer housing as the body S slides axially within the bore of the choke C.

The embodiment of the invention resides in the actuator A.

The actuator A comprises an outer housing 1 and a mandrel in the form of a mandrel sleeve 5 that is connected at its lower end to the choke body S. The mandrel sleeve 5 is disposed within the bore of the outer housing 1, and is axially movable therein. Since it is connected to the choke body S, axial movement of the mandrel sleeve 5 also moves the choke body S axially within the bore of the outer housing 1, to line up the apertures in the outer housing with the apertures in the choke body S, thereby permitting fluid to flow into the production tubing.

The mandrel sleeve 5 is sealed to the inner bore of the outer housing 1 by Chevron seals 6, 7, and an annulus 8 is formed between inner surface of the outer housing 1, and the outer surface of the mandrel sleeve 5. The seals 6, 7 seal off the annulus 8 at each end.

A locking sleeve 12 is disposed around the outer surface of the mandrel sleeve 5, and is located within the annulus 8. The locking sleeve 12 can normally move freely relative to the mandrel sleeve 5, but fits closely around the mandrel sleeve 5, leaving a further annular space between the outer surface of the locking sleeve 12 and the inner surface of the outer housing 1. The locking sleeve 12 is axially movable within the annulus 8, relative to the mandrel sleeve 5, and is biased towards the lower end of the apparatus by a spring 2 seated between an inwardly extending shoulder on the housing 1, and an outwardly extending shoulder 12S on the locking sleeve 12. The outwardly extending shoulder 12S on the locking sleeve 12 extends into the further annular space, and the shoulder 12S is disposed between two axially spaced snap rings connected to the housing 1, so that the extent of axial movement of the locking sleeve 12 within the housing is restricted by the snap rings.

The annulus 8 also houses a shuttle sleeve 10, mounted coaxially on the mandrel sleeve 5 and moveable relative thereto in the same way as the locking sleeve 12. The shuttle sleeve 10 is formed of two portions. A first portion 10A at the upper end of the shuttle sleeve has a larger diameter than the locking sleeve 12, and receives the locking sleeve 12 within the bore of the first portion 10A, so that the shuttle sleeve 10, the locking sleeve 12, and the mandrel sleeve 5 are all concentric, with the locking sleeve 12 disposed between the first portion 10A of the shuttle sleeve on the outside, and the mandrel sleeve 5 on the inside.

The second portion of the shuttle sleeve is in the form of a radially thickened portion 10B at the lower end of the shuttle sleeve 10, and has a shoulder 10S facing radially inwards on its inner surface. The radial measurement of the thickened portion 10B is substantially similar to the radial measurement of the annulus 8, so the thickened portion 10B of the lower end of the shuttle sleeve substantially fills the annulus 8, and spaces the first portion 10A radially away from the mandrel sleeve 5 to create a further annulus to accommodate the locking sleeve 12 between the first portion 10A and the mandrel sleeve 5.

The thickened portion 10B is provided with seals in the form of o-rings 10C, which seal the shuttle sleeve 10 against the inner surface of the outer housing 1, and against the outer surface of the mandrel sleeve 5. The seals 10C can be of any desired type.

Below the thickened portion 10B, an annular shoulder 5S extends radially outward from the mandrel sleeve 5 into the annulus 8, and prevents axial movement of the shuttle sleeve 10 beneath the annular shoulder 5S.

The outer housing 1 has first and second control channels adapted to connect to control lines (not shown) to control the axial movement of the mandrel sleeve 5 within the housing 1. The first control channel 13 extends axially through the housing 1 on one side from the upper part of the outer housing 1 to the lower part, and connects a control line port 13P on the outer surface of the housing 1 with the annulus 8 in the region of the shoulder 5S located between the sealed lower portion 10B of the shuttle sleeve 10 and the lower chevron seal 7. The second control channel 14 extends axially through the other side of the housing 1 connecting a control line port 14*p* situated at the upper part of the housing 1, to a section of the annulus 8 just below the lower snap ring, between the upper chevron seals 6 and the sealed thickened portion 10B of the shuttle sleeve 10.

The detent mechanism and its interaction with the mandrel sleeve 5 will now be explained.

The outer surface of the mandrel sleeve 5 has at least one axial arrangement of five independent grooves 15, 16, 17, 18 and 19. The grooves 15-19 are axially aligned with one another perpendicular to the axis of the mandrel. More than one line of grooves can usually be provided, but the FIGS. 1-7 show only one line of grooves for simplicity.

The lower end of the locking sleeve 12 distal to the spring 2 carries a respective dog 21 for each line of grooves in the mandrel sleeve 5. The dog 21 is carried in a cage extending radially through the locking sleeve 12. In the embodiment shown, the dog 21 is in the form of a spherical ball, but in other embodiments of the invention, the dog can take the form of a generally square block with flat faces and generally rounded or chamfered edges. The dog 21 is free to travel radially through the cage relative to the locking sleeve 12, but it is captive within the cage because the radial dimensions of the annulus and the locking sleeve are chosen to prevent the dog 21 from falling completely out of the cage i.e. the dog 21 has a greater radial dimension than the available space in the annulus 8 radially outwards from the locking sleeve.

The shuttle sleeve 10 has a recess 10R on its inner surface. The recess 10R is generally in the form of a shallow groove having a circumferential dimension that is suitable for receiving the dog 21 within the groove.

When the apparatus is assembled ready for use, the locking sleeve 12 is biased downward relative to the housing 1 towards the choke by the action of the spring 2. When the choke is fully closed, the dog 21 captive in the cage on the locking sleeve 12 is normally aligned with the first groove 15 on the mandrel sleeve 5, and is pressed radially inwards into the groove 15 by the inner face of the shuttle sleeve 10, which encircles the lower end of the locking sleeve 12, and prevents the dog 21 from moving radially outward through the cage. Thus, when the end of the shuttle sleeve 10 overlaps the cage on the locking sleeve 12, the dog 21 is forced radially inwards, straddling the junction between the locking sleeve 12 and the groove 15. While the dog 21 is held within the groove 15 like this, the locking sleeve 12 is locked to the mandrel sleeve 5, and the relative axial movement possible between the two is limited to the length of the groove 15.

Figure 2A:
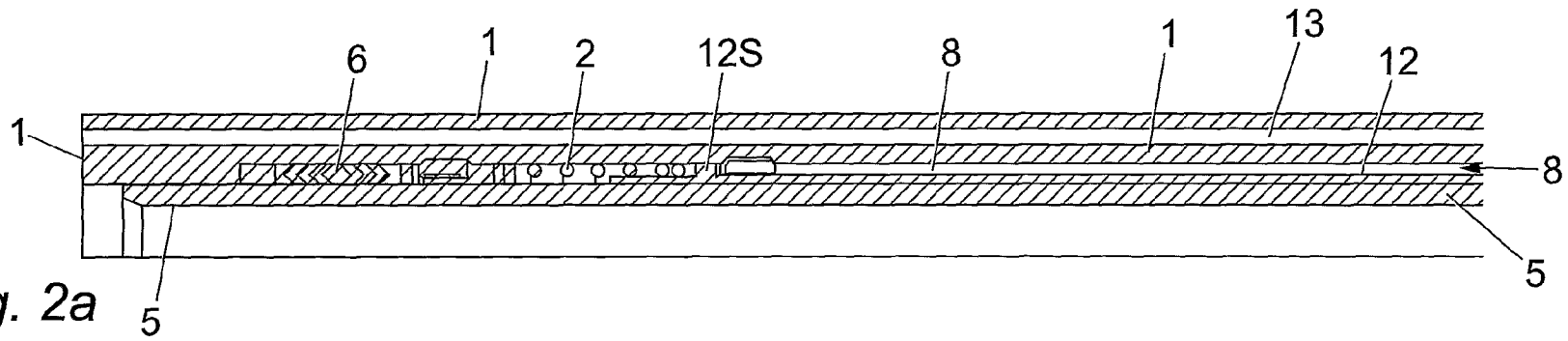
FIGS. 2*a, b* shows an upper and lower end of the portion of the FIG. 1 apparatus shown in box A, in a first configuration.
Figure 2B:
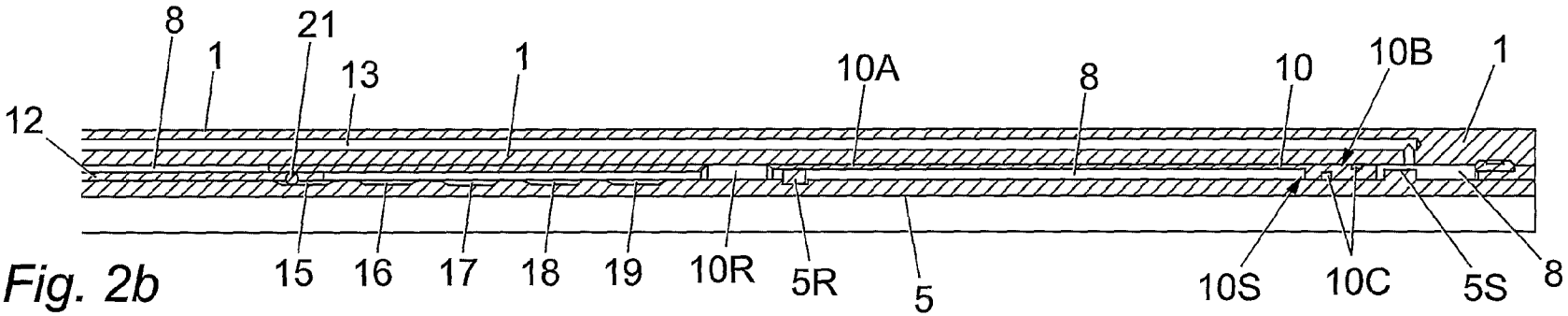

When the apparatus is inactive, and the choke is closed, the apparatus assumes the configuration shown in FIG. 2. In this configuration, the dog 21 is forced radially inwards into the groove 15, and the locking sleeve 12 is locked to the mandrel sleeve 5.

When the choke is to be opened, the control channel 13 is pressurised, which creates a pressure differential across the seals 10C of the shuttle sleeve 10. The higher pressure below the seals 10C induces the shuttle sleeve 10 to move axially upwards in the annulus 8, so that the apparatus moves towards the configuration shown in FIG. 3. At some point on this travel, the recess 10R overlaps the groove 15, and the dog 21 can then move radially outwards in the cage of the locking sleeve 12, but due to the high coefficient of friction between the mandrel sleeve 5 and the housing 1, and the fact that the locking sleeve 12 is biased downwards by the force of the spring 2, the locking sleeve 12 does not move relative to the mandrel sleeve 5 as a result. When the recess 10R passes above the groove 15, the dog 21 is forced once again into the groove 15 by the shuttle sleeve 10.

Figure 3A:
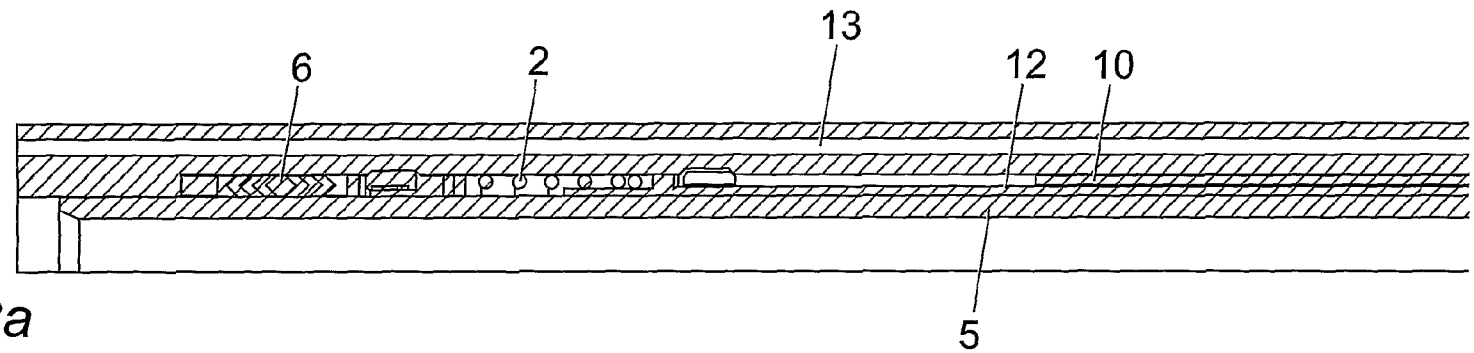
FIGS. 3*a, b* shows an upper and lower end of the portion of the FIG. 1 apparatus shown in box A in a second configuration.
Figure 3B:
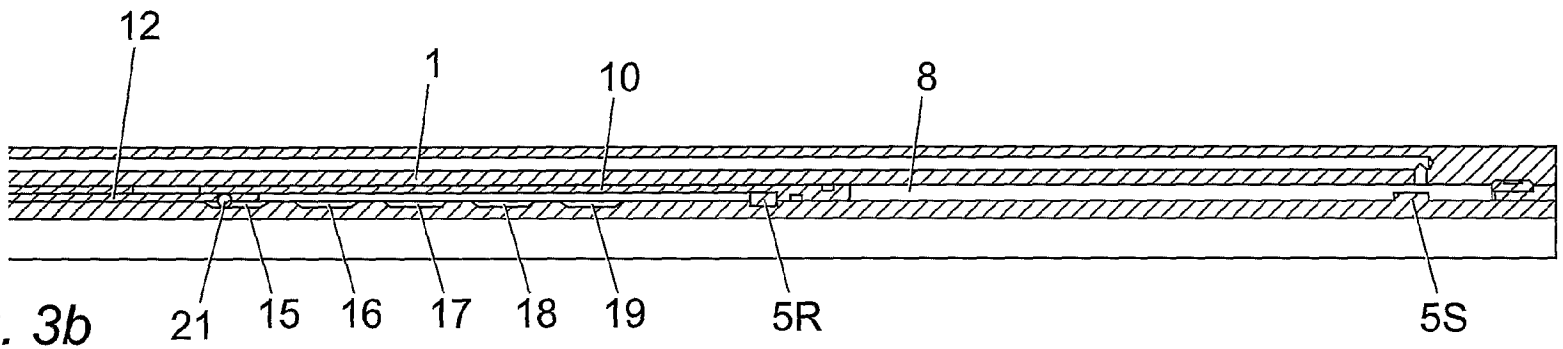

When the upwardly moving shuttle sleeve 10 reaches the point shown in FIG. 3, the inwardly facing shoulder 10S on the shuttle sleeve 10 abuts against a snap ring 5R on the mandrel sleeve 5, so that upward force exerted by the shuttle sleeve 10 is transmitted to the mandrel sleeve 5, thereby moving the mandrel sleeve 5 upwards through the housing 1 along with the shuttle sleeve 10. Further movement of the shuttle sleeve 10S as a result of the pressure differential moves the mandrel sleeve 5 axially upwards through the bore of the housing 1.

Figure 4A:
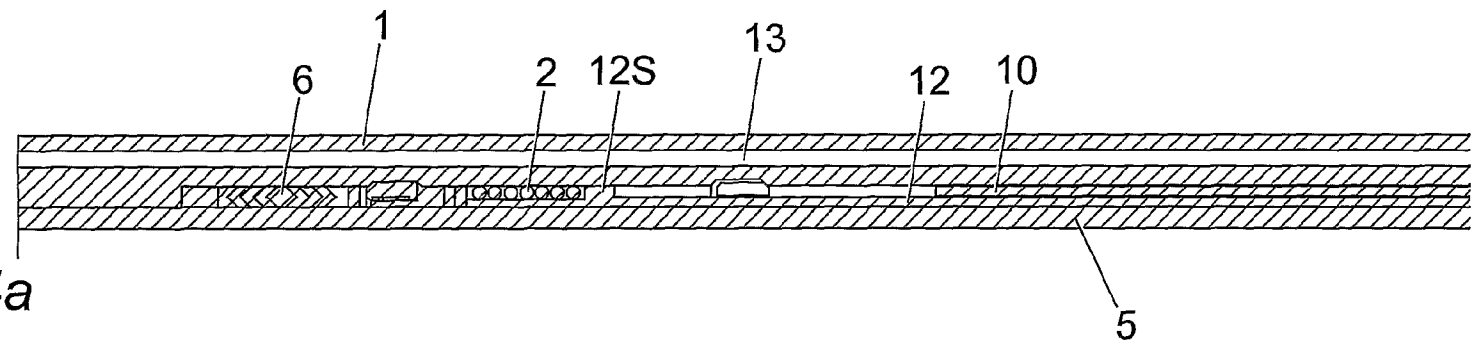
FIGS. 4*a, b* shows an upper and lower end of the portion of the FIG. 1 apparatus shown in box A, in a third configuration.
Figure 4B:
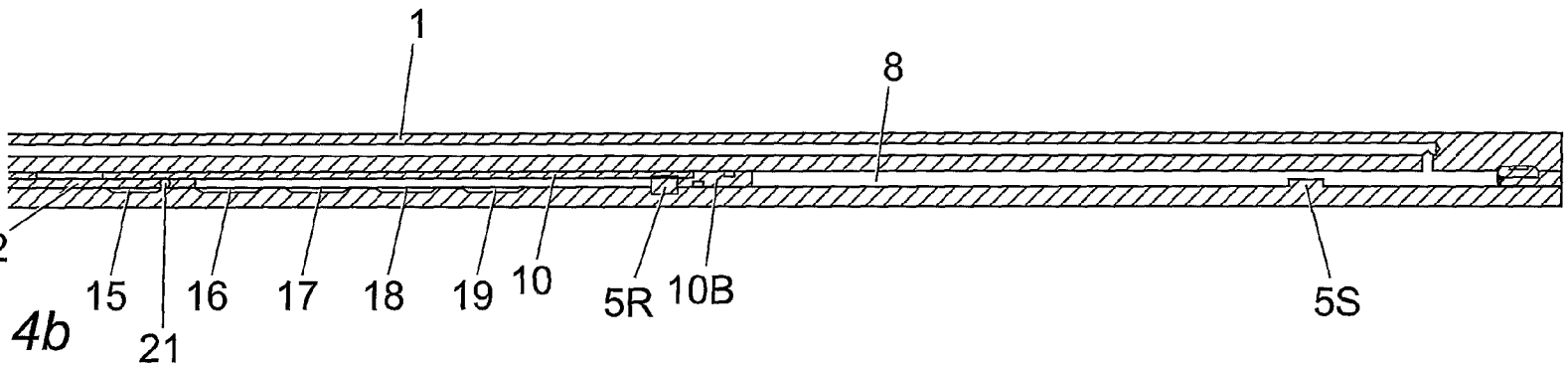

The locking sleeve 12 remains stationary while the shuttle sleeve 10 and the mandrel sleeve 5 are moving upwards together, causing the groove 15 to track upwards relative to the stationary dog 21, until the dog 21 hits the lower end of the groove 15 as shown in FIG. 4. At this point, the upward force exerted on the mandrel sleeve 5 by the shuttle sleeve 10 is transmitted to the locking sleeve 12 by the dog 21, which is pressed against the lower end of the first groove 15. This causes the locking sleeve 12 to move upwards relative to the housing 1 along with the mandrel sleeve 5 and the shuttle sleeve 10, thereby compressing the spring 2 between the upper snap ring and the shoulder 12S.

The locking sleeve 12 eventually shoulders out on the upper snap ring support collar and at that point, the mandrel cannot move upwards any further. At that point, the pressure differential moving the shuttle sleeve upwards can be removed, by depressurizing the "open" control line 13 and pressurizing the "close" control line 14, which creates a pressure differential across the seals 10C in the opposite direction, causing the shuttle sleeve 10 to move downwards towards the choke. In some embodiments, the "close" line 14 can be omitted, and the shuttle sleeve 10 can be returned to its initial position under the action of a spring (not shown).

The shoulder 10S then disengages from the snap ring 5R, removing the force pushing the mandrel sleeves upwards. The mandrel sleeve 5 is generally a heavy component, and high frictional forces acting between the sleeve 5 and the housing 1 generally create an inertial resistance to relative movement between the two. After disengagement of the shuttle sleeve 10 from the mandrel shoulder 5S, the force of the spring 2 biasing the locking sleeve 12 downwards keeps the dog 21 driven against the lower end of the first groove 15. The frictional inertia of the mandrel sleeve 5 is not overcome by the force of the spring, and thus the mandrel sleeve 5 and the locking sleeve 12 remain generally stationary in the housing, as the shuttle sleeve 10 moves down under the force of the pressure differential.

Figure 5A:
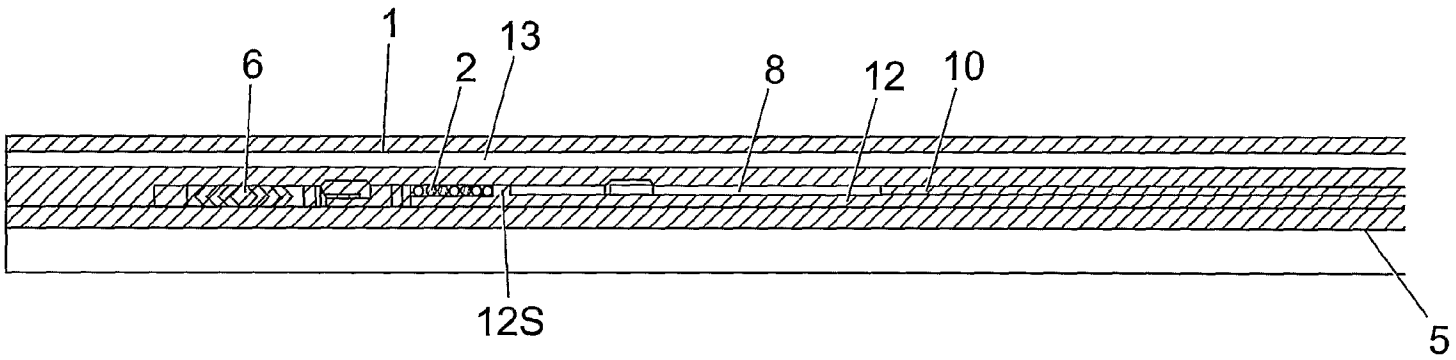
FIGS. 5*a, b* shows an upper and lower end of the portion of the FIG. 1 apparatus shown in box A, in a fourth configuration.
Figure 6A:
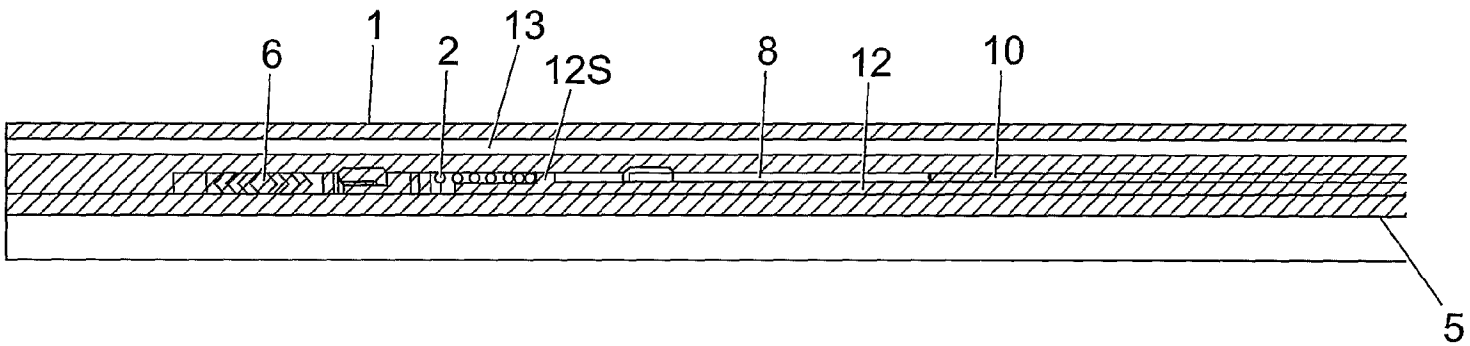
FIGS. 6*a, b* shows an upper and lower end of the portion of the FIG. 1 apparatus shown in box A, in a fifth configuration.
Figure 7A:
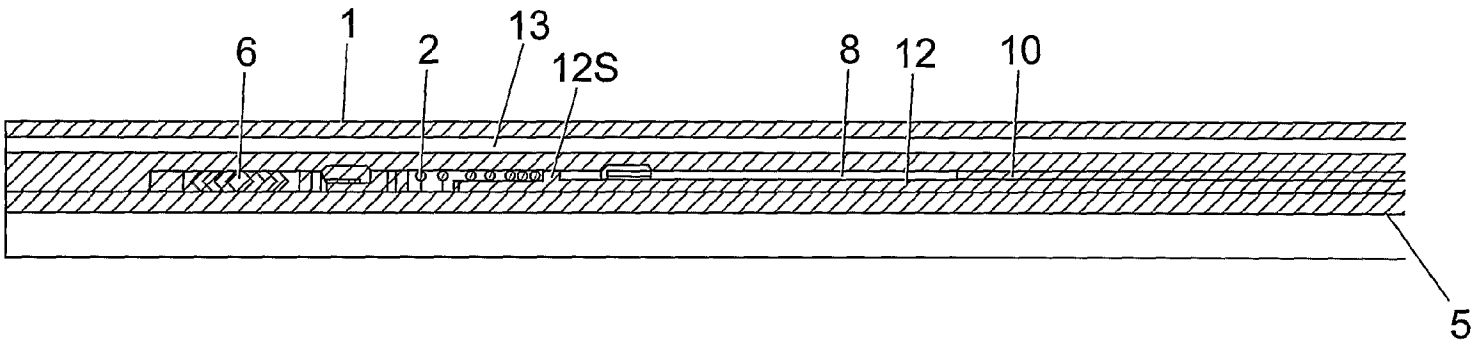
FIGS. 7*a, b* shows an upper and lower end of the portion of the FIG. 1 apparatus shown in box A, in a sixth configuration.
Figure 5B:
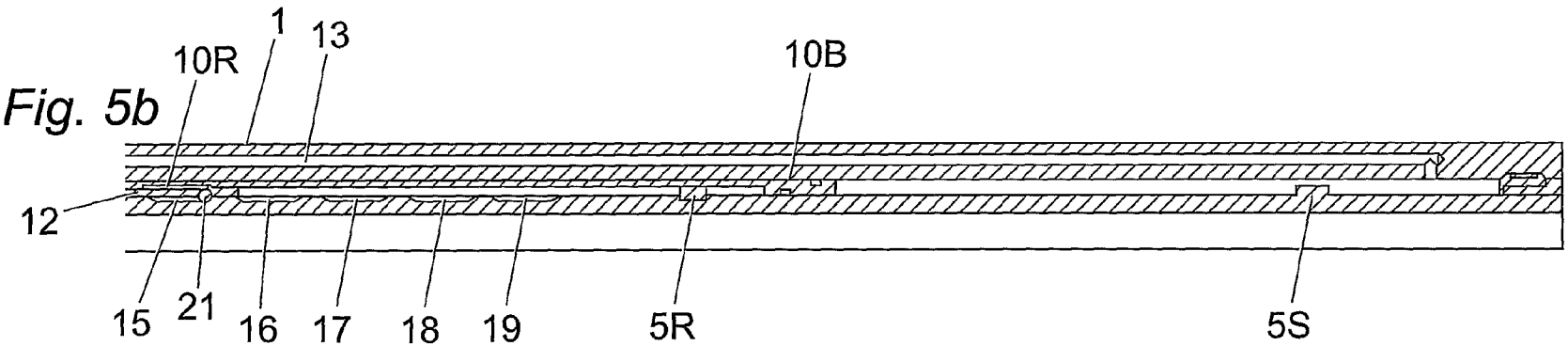
Figure 6B:
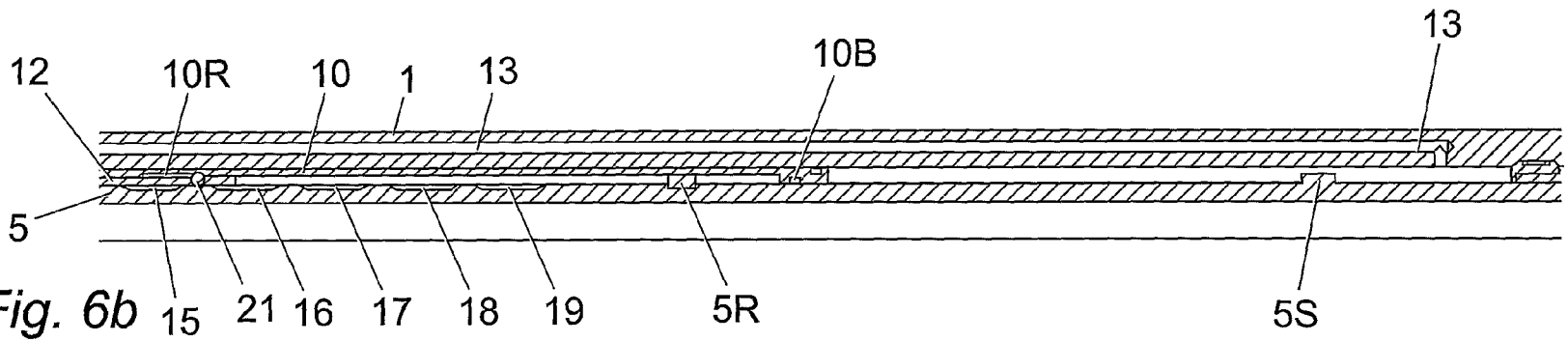
Figure 7B:
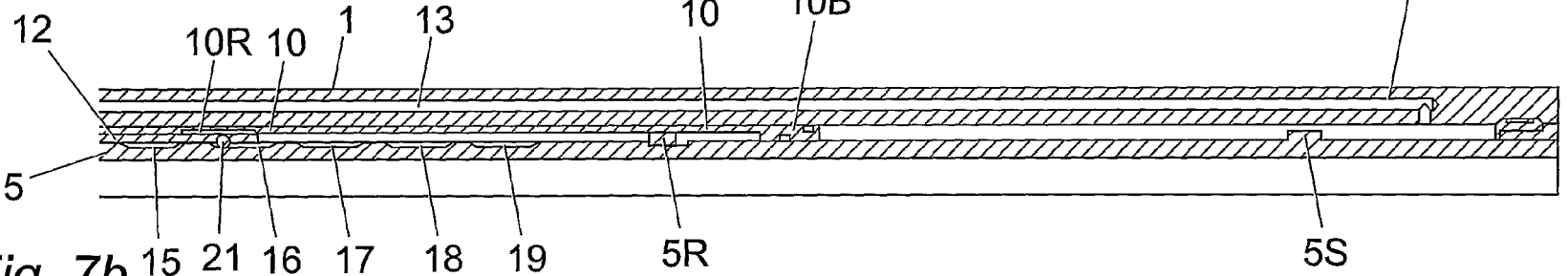

The shuttle sleeve continues to move until it reaches the point shown in FIG. 5, where the shuttle sleeve 10 has moved down relative to the locking sleeve 12 and the mandrel sleeve 5 so that the lower end of the recess 10R once more overlaps the cage containing the dog 21 at the lower end of the first groove 15. At this point, the dog 21 can move radially outwards in the cage, escaping from the first groove 15. While the frictional forces retarding the movement of the mandrel sleeve 5 are high, the locking sleeve 12 is freely movable relative to the mandrel sleeve 5, and is only held against further downward movement by the dog 21 abutting the end of the first groove 15. When the recess on the shuttle overlaps the cage, the dog 21 is freed from the confines of the first groove 15; it is driven against the lower end of the recess 10R and travels up the sloped end of the first groove and out of the groove 15, so that the dog 21 then moves with the lower end of the recess 10R over the bridge between the first 15 and the second 16 grooves, as shown in FIG. 6. The frictional resistance of the mandrel sleeve in the housing substantially prevents any accompanying movement of the mandrel sleeve 5.

At this point, the shuttle sleeve 10 is locked to the locking sleeve 12 by the dog 21 and the recess 10R, and the spring 2 acting on the locking sleeve 12 moves the assembly of the shuttle sleeve 10 and the locking sleeve 12 downwards relative to the mandrel sleeve 5, until the dog moves off the bridging section between the first two grooves, and drops into the second groove 16. At this point, shown in FIG. 7, the spring 2 pushes the locking sleeve 12 down until the shoulder 12S abuts against the lower snap ring, at which point the dog 21 has adopted a position about halfway along the second groove. As the dog moves radially inwards into the second groove 16, the shuttle sleeve 10 is unlocked from the locking sleeve 12, and thus the shuttle sleeve can continue its downward movement under the force of the pressure differential independently of the locking sleeve 12. Eventually the upper end of the recess 10R passes the dog 21, thereby forcing the dog 21 radially inwards into the second groove 16, and locking the mandrel sleeve 5 to the locking sleeve 12 once more; note that following the transition, the mandrel sleeve has now traveled up the bore of the housing, having the second groove 16 engaged with the locking sleeve instead of the first 15.

After the dog has been driven inwards from the recess 10R, the shuttle sleeve 10 continues its downward travel until it reaches the shoulder 5S.

At this point, the shuttle sleeve 10 has returned to its original configuration shown in FIG. 1, except that the mandrel has moved upwards by an amount defined by the distance between the upper ends of the first and second slots. The same procedure can then be followed for moving the mandrel sleeve 5 upwards by engaging the shoulder 10S with the snap ring 5R to push the mandrel sleeve up, compress the spring 2, and allow the shuttle sleeve 10 to return to the lower end of the annulus 8, but with the exception that the dog 21 starts at the second groove 16, and jumps to the third groove 17 when the recess 10R overlaps with the cage on the locking sleeve 12. Thus the mandrel sleeve (and the choke to which it is attached) can be moved stepwise upwards through the mandrel between sequential positions that are defined by the physical stops of the groove ends, and not by variable factors such as pressure differences and volumes of injected fluids.

The distances between the groove start and end points (defining the extent of movement of each transition) are the same in the example shown in the drawings. When the dogs 21 engage the different grooves, the choke body S adopts a different axial position that uncovers a different row of apertures (P1, P2 or P3) to admit production fluids. The combined surface area for the apertures can be regular at each axially spaced point along the choke, or different axially spaced points along the choke body S can have different sizes of aperture P1, P2, P3, as in this example.

Figure 8:
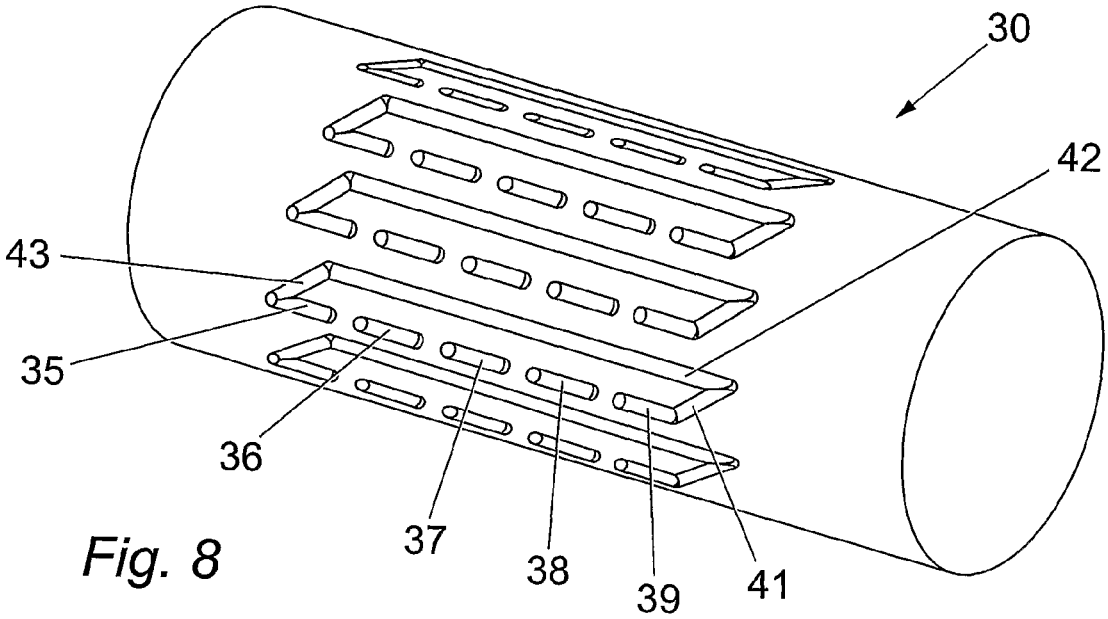
FIGS. 8 and 9 show grooved portions of alternative designs of mandrel suitable for the apparatus shown in FIG. 1.

When the dog 21 travels to the last groove 19, the device can either be recovered to surface for resetting, or alternatively the apparatus can optionally be provided with a downhole reset function. FIG. 8 shows one embodiment of a mandrel sleeve 30 with a reset track between the first 35 and last 39 grooves in each line. The reset track comprises a first circumferential section 41 leading from the lower end of the last groove 39 in the line, an axial section 42 extending axially from the end of the circumferential section 41, and a second circumferential section 43 connecting the upper end of the axial section 42 with the upper end of the first groove 35.

The first circumferential section 41 has a circumferential component and an axial component, as the angle between the groove 39 and the circumferential section is oblique (approximately 120°). The dog 21 restrained in the last groove 39 therefore moves to the end of the groove 39 under the force of a spring as described for previous embodiments, and is diverted under the same force into the first circumferential section 41. The corner between the first circumferential section 41 and the groove 39 can optionally be chamfered or otherwise shaped in a known manner to encourage the dog to enter the circumferential section 41. When the pressure (or other force driving the dog 21) is reversed, the dog 21 can is then driven down the axial section 42 to the end of the second circumferential section 43. The upper end of the axial section 42 can be chamfered in a known manner to cause the dog 21 to move into the axial section 42 in preference to the circumferential section 41. The dog 21 travels down the axial section 42 until it reaches the corner with the second circumferential section 43, which is again an oblique angle so that the dog 21 is guided into the end of the second circumferential section 43, where it stops at the top corner of the second circumferential section 43 and the upper end of the first groove 35. This corner is again chamfered on its inner surface to guide the dog 21 into the first groove 35 upon another reversal of the force driving the dog 21.

The embodiment of the mandrel sleeve 30 shown in FIG. 8 can be used to automatically return the assembly to the starting position after the last transition from the fourth to the fifth groove, either under the force of a return spring, or advantageously under the action of the close line 14, driving the dog 21 through the reset track as described.

Figure 9:
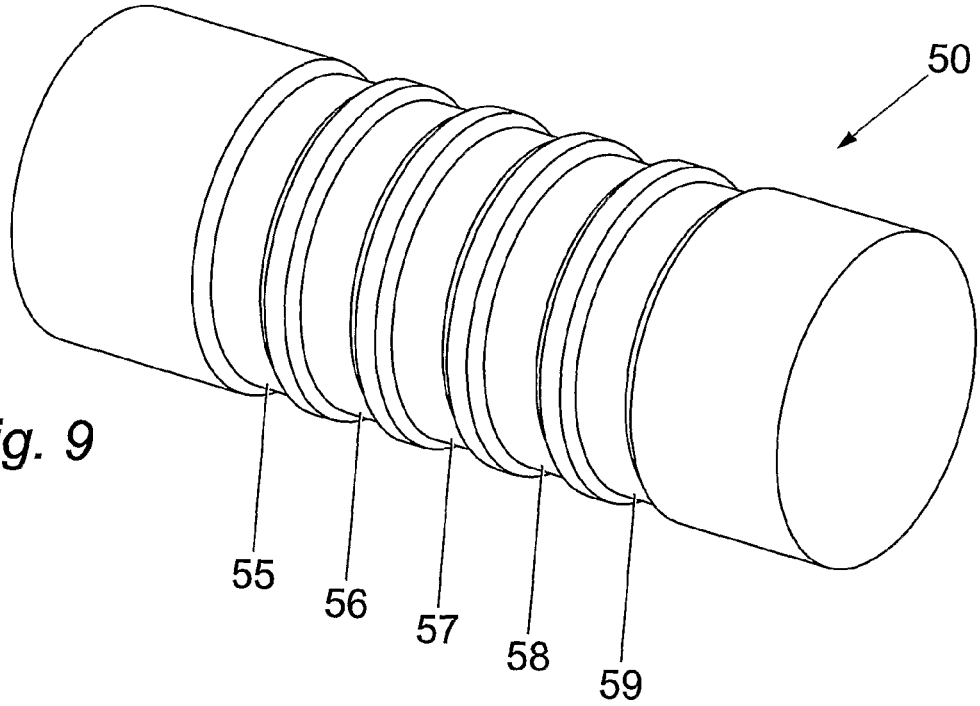
Figure 10:
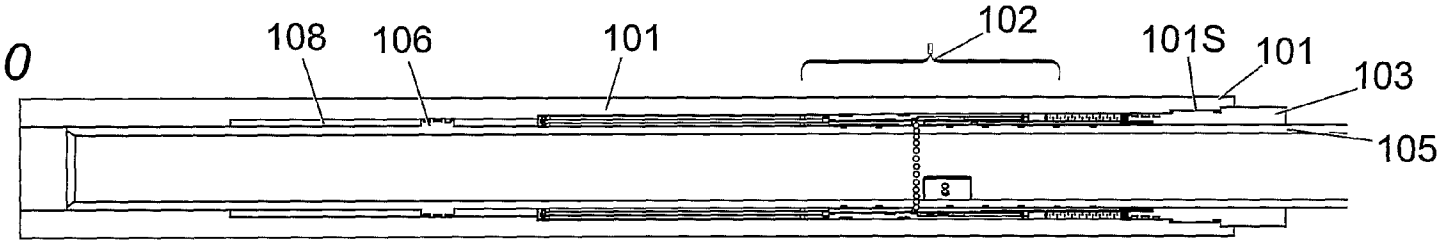
FIG. 10 shows a side view of a fourth embodiment of an actuator device for a choke.
Figure 11:
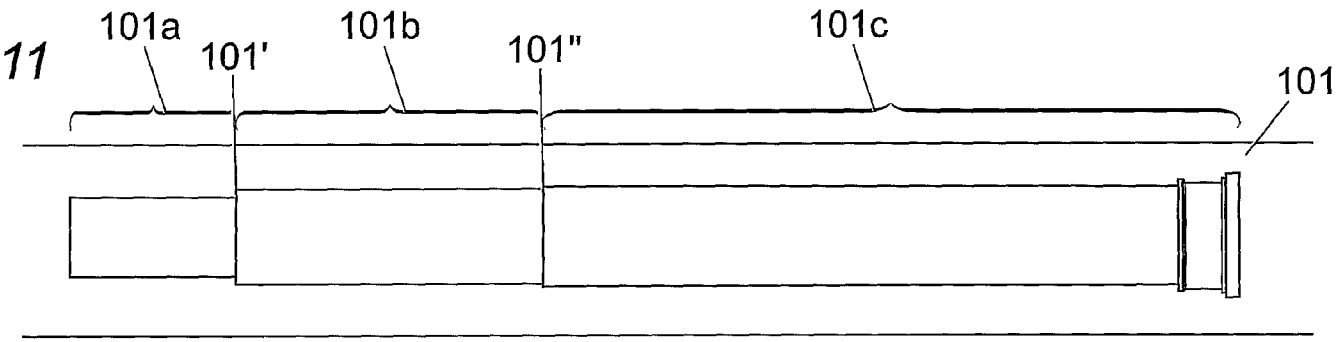
FIG. 11 shows a housing for the fourth embodiment.
Figure 12:
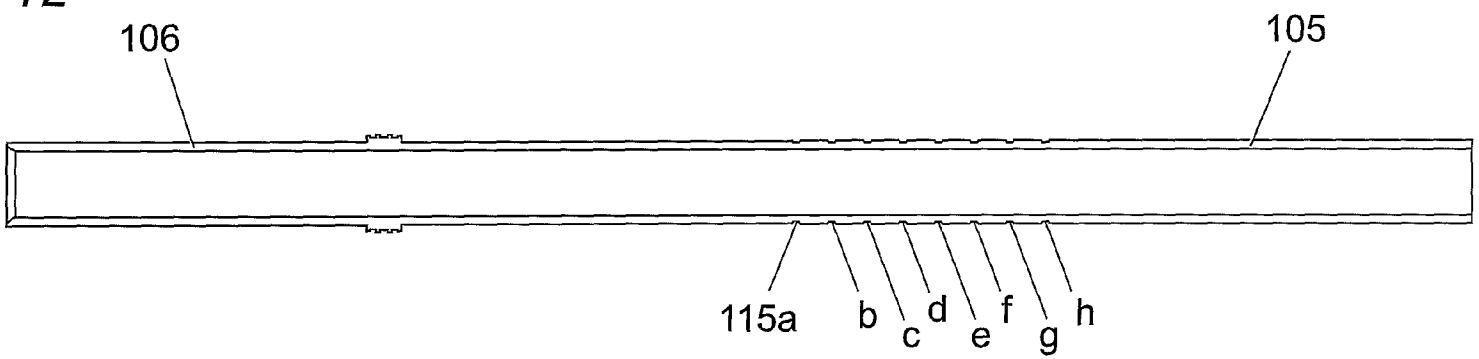
FIG. 12 shows a mandrel for the fourth embodiment.
Figure 14:
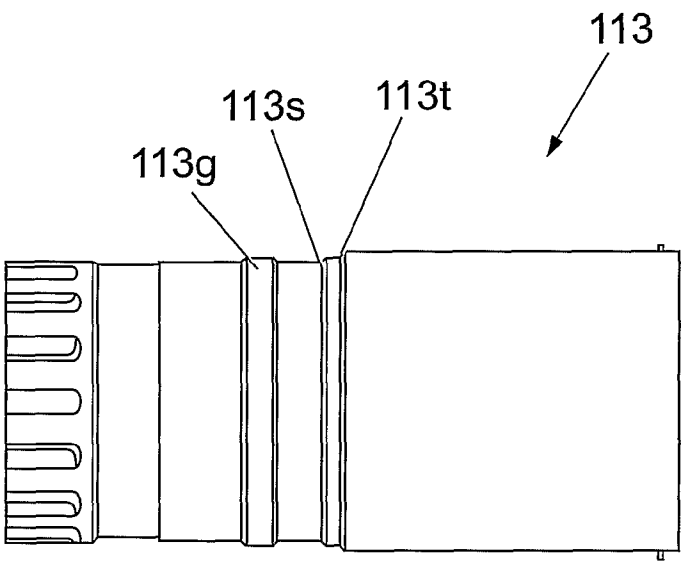
FIG. 14 shows a side view of a control sleeve of the fourth embodiment.
Figure 13:
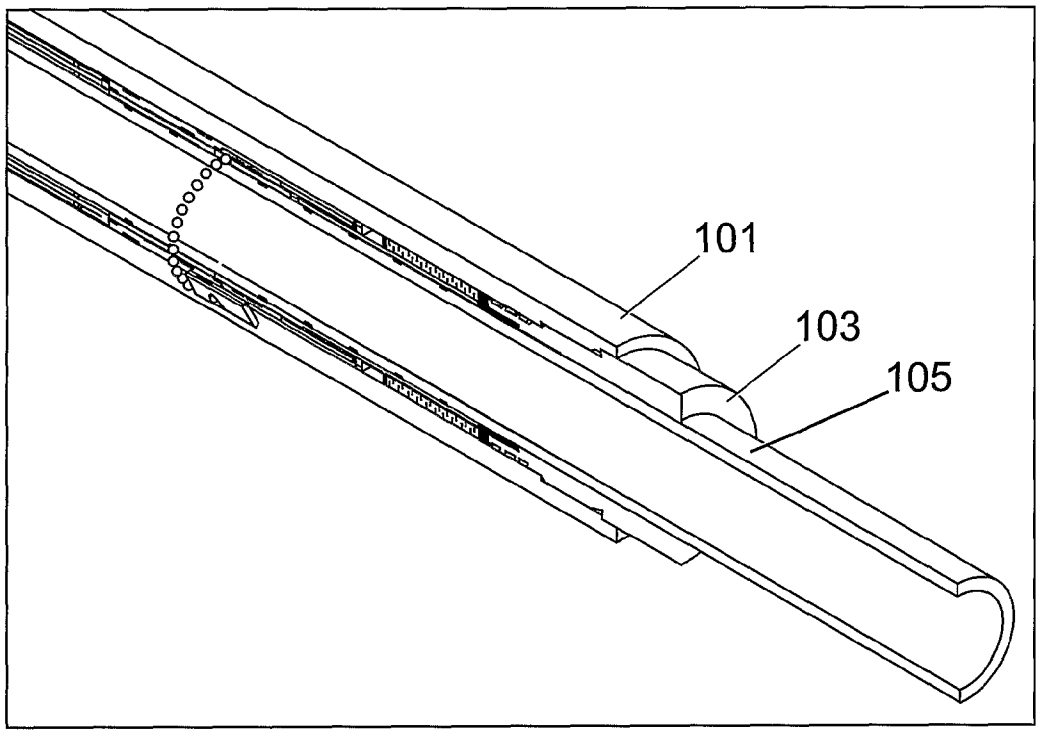
FIG. 13 shows a perspective view of the mandrel in the housing of the fourth embodiment.
Figure 15:
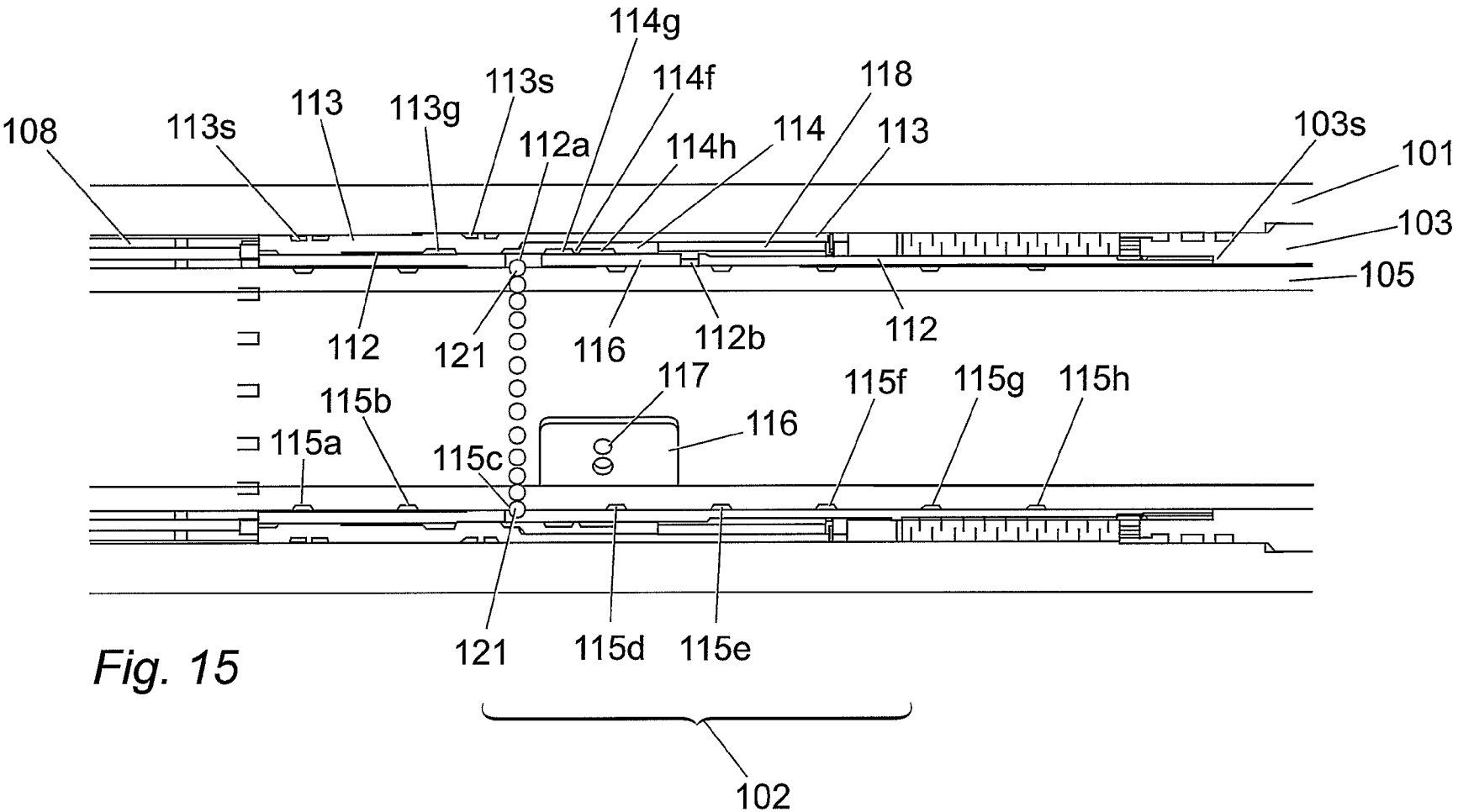
FIG. 15 shows a close up side view of a detent mechanism of the fourth embodiment.

FIG. 9 shows another design of mandrel sleeve 50 having annular grooves 55-59 extending around the outer diameter of the mandrel 50. The dog 21 is received within the grooves 55-59 during successive transitions, as described for the earlier embodiments. Typically, the variant with the mandrel 50 would be recovered to surface for resetting after the last transition from groove 58 to groove 59.

Referring now to FIGS. 10-14, a fourth embodiment of an actuator for actuating a downhole device is shown. The fourth embodiment has a housing 101 and a mandrel sleeve 105, and a detent mechanism 102.

The downhole device being actuated by this embodiment is attached to the mandrel sleeve 105, but is not shown in FIGS. 10-14. It could be a sleeve valve such as a choke, but could also be any other device adapted to be operated by axial movement transmitted by the mandrel. The mandrel 105 moves the downhole device (choke, sleeve valve etc) within the bore of the housing 101 or within the bore of other tubing connected to the housing 101.

The mandrel sleeve 105 is disposed within the bore of the outer housing 101, and is axially movable therein. The housing 101 is stepped at 101' and 101" at which points the inner diameter increases. The bore of the lower portion of the housing 101*a* is narrower than bore of the upper portions 101*b* and 101*c*.

The mandrel sleeve 105 can be sealed (e.g. at 106) to the inner bore of the outer housing 101 and an annulus 108 is formed between inner surface of the outer housing 101, and the outer surface of the mandrel sleeve 105. The annulus 108 is wider at 101*b* and at 101*c* to receive the detent mechanism 102. The upper end of the annulus 108 is sealed with a connector sub 103 that is screwed onto the upper end of the housing 101, but in which the mandrel sleeve 105 can slide axially.

The mandrel 106 (best shown in FIG. 12) has a set of annular grooves 115*a-h* that are parallel to one another and perpendicular to the axis of the mandrel sleeve 105. The grooves 115*a-h* receive caged dogs as described in relation to the earlier embodiments in order to lock the mandrel sleeve 105 against axial movement in relation to the housing 101. The dogs can be blocks as described earlier, but in this embodiment, the dogs are a lower race of balls 121 that are retrained in an annular arrangement of apertures 112*a* in a cage sleeve 112, which is disposed around the outer surface of the mandrel sleeve 105, and is located within the annulus 108. The cage sleeve 112 thus performs a similar function to the locking sleeve 12 in the first embodiment. The mandrel sleeve 105 can slide axially relative to the cage sleeve 112 (in certain circumstances) and the cage sleeve 112 is a close fit around the mandrel sleeve 105, leaving a further annular space between the outer surface of the cage sleeve 112 and the inner surface of the outer housing 101. The cage sleeve 112 (and thus the caged balls 121) is axially fixed within the annulus 108 since the upper end of the cage sleeve 112 is screwed onto the connector sub 103 at 103*s*, which is screwed onto the housing 101 at 101*s*.

The cage sleeve has three further apertures 112*b* spaced around the circumference of the sleeve 112, and set above the apertures 112*a* holding the balls 121. The apertures 112*b* are rectangular, and receive slightly shorter rectangular sliders 116 that are free to slide axially (but not circumferentially) within the confines of the apertures 112*b*. The sliders 116 have apertures extending through from inner face to outer face, which hold an upper row of caged balls 117 that can protrude through either face of the slider.

On the outer surface of the cage sleeve 112 there is a control ring 113 that is slidable within the annulus 108 over the cage sleeve 112 and the mandrel 105. The outer surface of the control sleeve is sealed to the inner surface of the housing 101 at 113*s*. At the lower end of the control ring 113 there is an annular reset groove 113*g* on the inner surface, below the apertures 112*a* holding the lower race of balls 121. The inner bore of the control ring 113 increases stepwise at shoulder 113*s* and again at shoulder 113*t*. The upper end of the control ring 113 above shoulder 113*t* therefore has a larger inner bore than the lower end, in order to create an annulus between the control ring 113 and the cage sleeve 112. The annulus receives a shuttle sleeve 114 that is slidable within the annulus, over the outer surface of the fixed cage sleeve 112. The shuttle sleeve 114 is also slidable within the bore of the control ring 113. The shoulders 113*t* and 113*s* face upwards in the assembled apparatus.

The shuttle sleeve 114 has a pair of adjacent annular grooves forming upper 114*h* and lower 114*g* pockets on its inner surface, above the apertures 112*a* holding the balls 121. The pockets 114*g* and 114*h* are separated by an inwardly projecting tang 114*t*. The pockets 114*g* and 114*h* are positioned over the slider 116, so that the ball 117 held captive in the aperture on the slider 116 can protrude through the outer face of the slider 116 into either the upper pocket 114*h* or the lower pocket 114*g*. The inner end of the tang 114*t* is close to the outer face of the slider 116, so the ball 117 cannot pass from one pocket 114*h* to the other 114*g* without retracting into the aperture on the slider 116 and protruding through its inner face. Thus the tang 114*t* must push the ball 117 back through the aperture on the slider 116 so that it protrudes through the inner face of the slider 116 before the ball 117 can move from one pocket 114*g/h* to the other.

The shuttle sleeve 114 is biased downwards by a wave spring 118 that is fixed to the upper end of the control ring 113, so the control sleeve is biased down to the lower end of the control ring 113.

The control ring 113, shuttle sleeve 114 and cage sleeve 112 are all mounted coaxially on the mandrel sleeve 105.

The outer housing 101 has first and second control channels (not shown) adapted to connect to control lines to control the axial movement of the mandrel sleeve 105 within the housing 101. The control channels can be configured in the same way as in earlier embodiments.

The cage sleeve 112 carries a ball 121 in each aperture 112*a*. The balls 121 are each adapted to drop radially into one of the circumferential grooves 115*a-h* on the outer surface of the mandrel sleeve 105. Instead of circumferential grooves, it would be possible to use axial arrangements of slots as in the first embodiment. Each ball 121 extends radially through the cage sleeve 112, and the diameter of each ball 121 is larger than the radial dimension of the cage sleeve 112, so that the balls protrude through the inner or the outer surface of the sleeve 112, and are captive within the apertures 112*a*.

Figure 16:
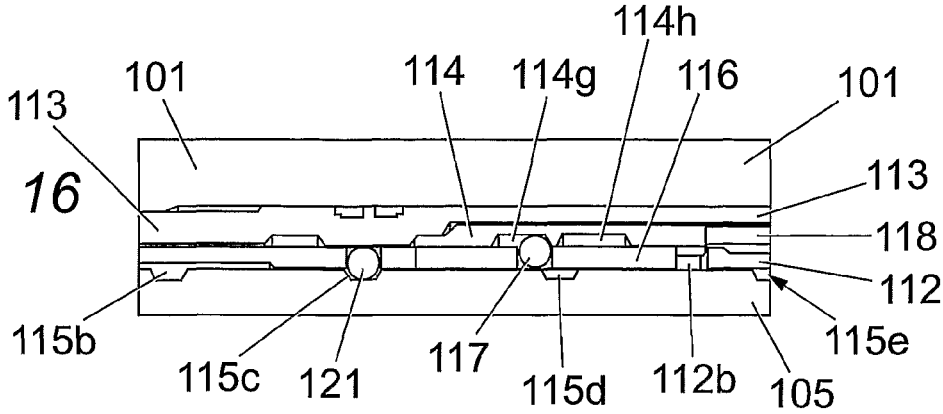
FIGS. 16-23 are sides views of the detent mechanism of FIG. 15 in sequential positions during operation.

When the apparatus is assembled ready for use with the mandrel drawn fully up within the housing 101, the balls 121 captive on the cage sleeve 112 are normally aligned with the first groove 115*a* on the mandrel sleeve 105, and are pressed radially inwards into the groove 115*a* by the inner face of the lower end of the control ring 113, which encircles the cage sleeve 112, and prevents the balls 121 from moving radially outward through the cage. The mandrel sleeve 105 is biased downwards in the bore by a strong spring (not shown) set in compression above it. In FIG. 16, the apparatus is shown with the mandrel already lowered in the housing by two stops, so that the balls 121 are pressed into the third groove 115*c*. The narrow bore at the lower end of the control ring 113 below shoulder 113*s* and above groove 113*g* radially covers the apertures 112*a*, and prevents the balls 121 from leaving the cage sleeve 112. The balls 121 therefore protrude out of the inner face of the cage sleeve 112 into the groove 115*c*, straddling the junction between the cage sleeve 112 and the groove 115*c* as shown in FIG. 16. This locks the mandrel 105 axially to the cage sleeve 112, and thus to the housing (because the cage sleeve 112 is screwed onto the housing at 103*s*). No axial movement of the mandrel sleeve 105 relative to the housing 101 is permitted in this initial configuration of the cycle.

The balls 117 on the slider 116 are pressed radially outwards by the outer surface of the mandrel sleeve 105, which forces the balls 117 into the lower pocket 114*g* on the shuttle sleeve 114. The tang 114*t* is pressed downwards against the balls in the lower pocket 114*g* because of the biasing action of the wave spring 118.

When the mandrel sleeve 15*c* is to be moved down under the force of the strong spring to open the choke (or operate another device by axial displacement), the control channel is pressurised, and the pressure moves the control ring 113 down in the annulus relative to the housing 101 and the mandrel sleeve 105. Although the shuttle sleeve 114 is movable within the annulus relative to the control ring 113, the ball 117 caged in the slider 116 is trapped in the lower pocket 114*g* of the shuttle sleeve 114 and is pressed against the lower edge of the tang 114*t*. Since the slider 116 is shouldered out on the upper end of the aperture 112*b* in the cage sleeve, the shuttle sleeve 114 stays still as the control ring 113 moves down, and the spring 118 above it compresses.

Figure 17:
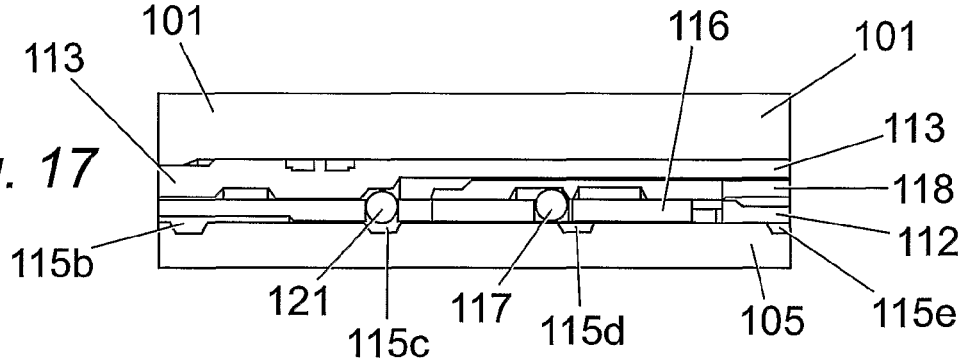

At some point on its travel, the shoulder 113*s* on the lower end of the control ring 113 crosses the groove 115*c*, exposing the larger diameter to the ball 121, and the ball 121 can then move radially outwards in the cage sleeve 112 to escape from the groove 115*c* in the mandrel 105. This is best shown in FIG. 17. Once the ball 121 moves radially out of the mandrel groove 115*c*, the mandrel sleeve 105 is no longer connected to the housing through the cage sleeve 112 and is free to move down in the bore. Therefore, the strong spring above the mandrel drives it downwards (slowly because of the high frictional forces) until the groove 115*c* passes axially below the balls 121 so that they can no longer enter the groove 115*c* as shown in FIG. 18.

Figure 18:
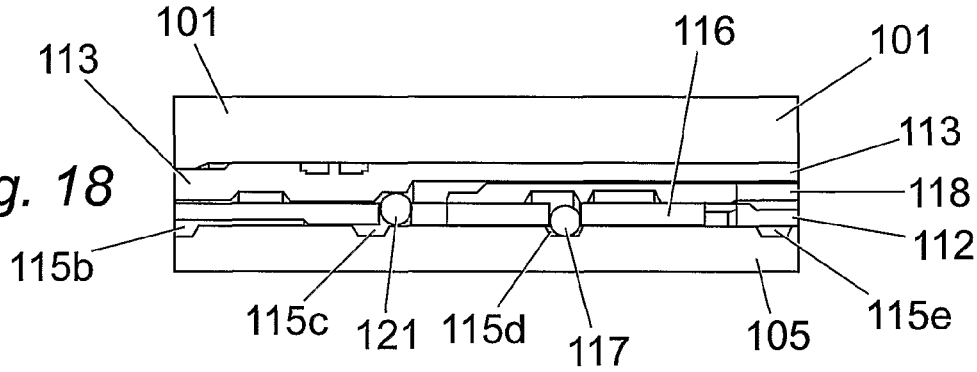

As the mandrel sleeve 105 moves down, the next groove up 15*d* on the mandrel sleeve 105 passes radially underneath the balls 117 held in the lower groove 114*g* of the slider 116 as shown in FIG. 18. This can be arranged to happen at the same time as the lower race of balls 121 are excluded from the groove 115*c*, or later. This permits the balls 117 to move radially inwards as shown in FIG. 18 to straddle the interface between the groove 115*d* and the shuttle sleeve 114. The balls 117 are pushed radially inwards into the mandrel groove 115*d* by the spring 118 pushing the tang 114*t* down relative to the mandrel sleeve 105. The sloped profile of the tang 114*t* and the curved surface of the balls translates the axial movement into the radial movement of the balls 117 into the groove 115*d* as shown in FIGS. 18 and 19.

The downwardly moving tang 114*t* presses the ball 117 in the groove 115*d*, and then passes it, so that the balls 117 are then axially aligned with the upper groove 114 in the inner surface of the shuttle sleeve 114, just as the lower end of the shuttle sleeve 114 contacts the lower balls 121. At that point, the upper balls 117 are free to move radially outwards into the upper groove 114*h*, so they are once more freed from the mandrel sleeve 105.

Figure 19:
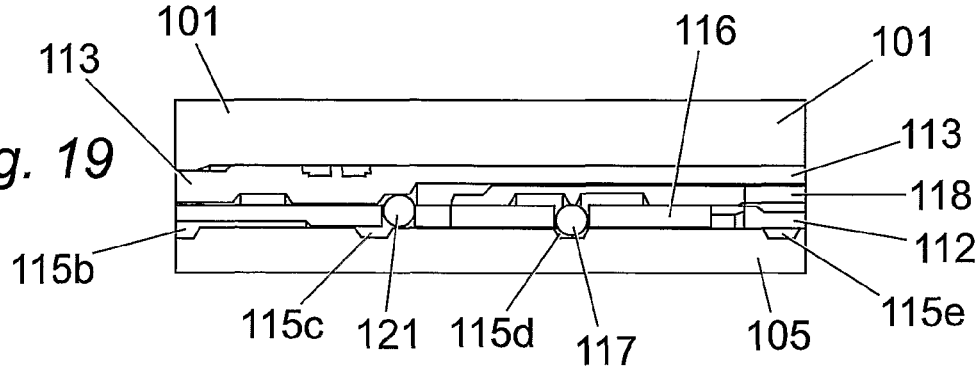
Figure 20:
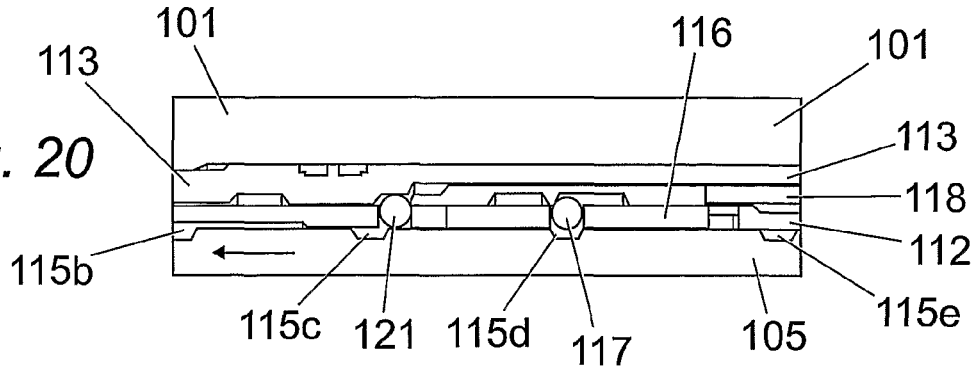
Figure 21:
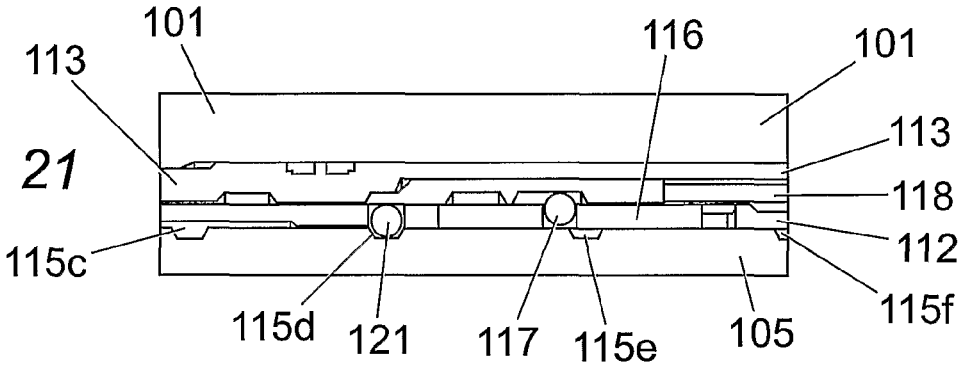

Thus when the shuttle device reaches the configuration shown in FIG. 19, the shuttle sleeve 114 is unlocked from the mandrel sleeve 105 so that it can be pushed down by the spring 118 relative to the control ring 113 and the cage sleeve 112 into the configuration shown in FIG. 21, where the lower tip of the shuttle sleeve 114 is pressing against the outer surface of the lower race of balls 121.

When the upper balls 117 are released from the mandrel grooves 115, the mandrel sleeve is then once more free to move down the bore under the force of the strong spring relative to the detent mechanism 102, until the groove 115*d* vacated by the upper balls 117 is has moved down to be axially aligned with the lower race of balls 121; when the groove 115*d* has lined up with the lower race of balls 121, the next groove up, 115*e*, has not yet reached the upper race of balls 117. At this point, the force on the shuttle sleeve 114 from the spring 118 pushes the shuttle sleeve downwards over the outer surface of the balls 121 to shoulder out against the shoulder 113*s* on the control ring 113, as shown in FIG. 21. This pushes the balls 121 into the groove 115*d* as it passes slowly underneath the apertures 112*a*. This locks the mandrel sleeve 105 once again to the cage sleeve 112, but note that the mandrel sleeve has now moved downwards by one groove 115, and the upper race of balls in now in the upper pocket 114*h*.

Figure 22:
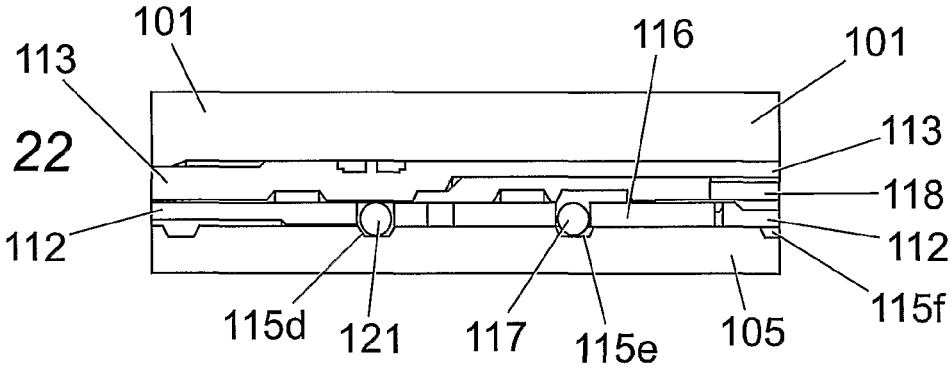

At this point, the pressure keeping the control sleeve 113 down is bled off, and the control ring 113 moves axially up the bore relative to the stationary mandrel sleeve 105. The shoulders 113*s* and 113*t* pick up the shuttle sleeve 114 and draw it upwards once more. The tang 114*t* contacts the lower surface of the upper race of balls 117, and drags them up the outer surface of the mandrel until they are aligned with the next groove up 115*e* on the mandrel sleeve 105, at which point, they are pushed radially into the groove 115*e* as the tang rides over their outer surfaces, as shown in FIG. 22. The sliders 116 move with the tang 114*t*, to the axial extent provided by the apertures 112*b*.

When the tang 114*t* crosses the outer surfaces of the balls 117, they can move radially outwards into the lower pockets 114*g*, disengaging from the mandrel sleeve 105, and ready for another cycle of pressuring up to move the mandrel sleeve 105 down another step.

Figure 23:
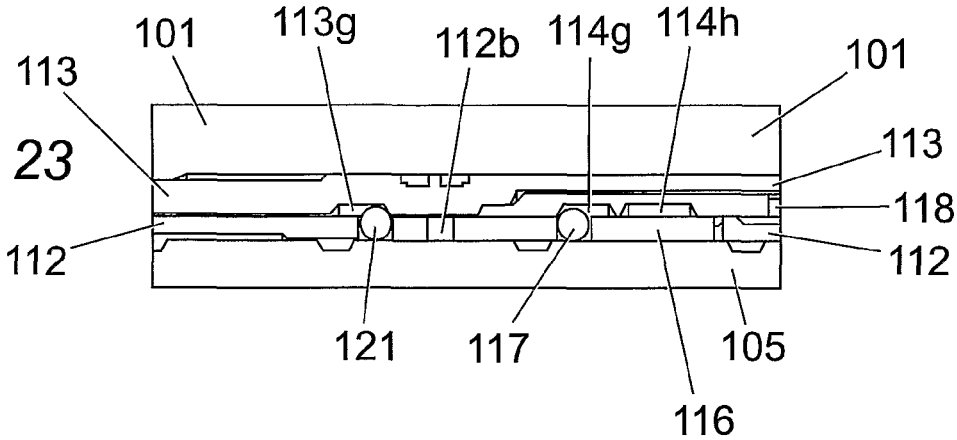

Once the required setting has been reached, and the mandrel sleeve 105 is to be withdrawn, the control ring 113 is moved upwards in the bore, picking up the shuttle sleeve 114 by means of the shoulders 113*s/t* and moving it up until the lower pocket 114*g* is axially aligned with the upper balls 117, freeing them to move radially outwards and disengage from the mandrel sleeve 105. At that point, best shown in FIG. 23, the lower race of balls 121 is then axially aligned with the reset groove 113*g* below the shoulder 113*s* on the control ring 113. When both of the ball races are disengaged from the mandrel in this way, the mandrel can be withdrawn using a separate control line to exert high pressure on it to reset it to the initial position. Since this is only a reset line, it does not need to be calibrated to specific movements to intermediate positions. Alternatively, the device can be recovered to surface for resetting.

Thus the mandrel sleeve (and the choke to which it is attached) can be moved stepwise between sequential positions that are defined by the physical stops of the grooves, and not by variable factors such as pressure differences and volumes of injected fluids. Movement in either direction is possible.

The distances between the groove start and end points (defining the extent of movement of each transition) are the same in the example shown in the drawings. As in earlier embodiments, the distances can be varied if desired, without changing the actuating pressures, which can be kept high to minimise losses.

Modifications and improvements can be incorporated without departing from the scope of the invention.

The invention claimed is:

1. Apparatus for controlling a downhole device, the apparatus comprising a housing, a control line, a shuttle device, a mandrel connected to the downhole device and moveable within the housing between at least three stops, each of the three stops defining a different configuration of the device; and a detent mechanism comprising a locking device which is movable relative to the mandrel to engage the mandrel to selectively lock the mandrel in one of the at least three stops within the housing; wherein the locking device comprises at least one dog on one of the mandrel and the locking device that is adapted to engage with a respective groove on the other of the mandrel and the locking device; wherein the locking device is unlocked from the mandrel by the movement of the shuttle device; and wherein a pressure differential is applied via the control line to the shuttle device to activate movement of the shuttle device to engage the locking device thereby disengage the locking device from the mandrel, allowing the mandrel to move between the at least three stops; and wherein the locking device can hold the mandrel in position while the shuttle device returns to its initial position for another cycle.

2. Apparatus as claimed in claim 1, wherein the at least three stops are defined by the grooves on the locking device.

3. Apparatus as claimed in claim 1, wherein the detent mechanism is actuable to selectively permit movement of the mandrel successively from one of the at least three stops to another of the at least three stops.

4. Apparatus as claimed in claim 1, wherein the detent mechanism is actuable and adapted to lock the mandrel in one of the at least three stops until the detent means is actuated to move the mandrel.

5. Apparatus as claimed in claim 1, wherein the mandrel is arranged to move in only one direction.

6. Apparatus as claimed in claim 1, wherein the at least three stops are axially spaced from one another.

7. Apparatus as claimed in claim 1, wherein the downhole device is a sliding sleeve valve.

8. Apparatus as claimed in claim 1, wherein the device is a choke, and wherein the at least three configurations are sequential graduated degrees of opening of the choke.

9. Apparatus as claimed in claim 1, wherein the movement of the mandrel in initial transitions is greater than the movement of the mandrel in later transitions.

10. Apparatus as claimed in claim 1 wherein the shuttle device is axially movable relative to the mandrel and has a defined range of movement independent of a position of the mandrel.

11. Apparatus as claimed in claim 1, wherein the shuttle device comprises a shuttle sleeve that interacts with the locking means in order to engage and disengage the locking means from the mandrel.

12. Apparatus as claimed in claim 1, wherein the at least one dog on the locking device can be moved into and out of engagement with the mandrel by the movement of the shuttle device.

13. Apparatus as claimed in claim 1, wherein the movement of the mandrel between different configurations is defined by the at least one groove.

14. Apparatus as claimed in claim 1, wherein at least two grooves are axially spaced from one another along the mandrel.

15. Apparatus as claimed in claim 1 wherein the groove includes a return groove to guide the movement of the mandrel back to its original configuration.

16. Apparatus as claimed in claim 1, having a close control line that overrides the interaction of the detent mechanism with the mandrel and returns the device back to its original configuration at the end of the last transition.

17. Apparatus for controlling a downhole device, the apparatus comprising a housing, a control line, a shuttle device, a mandrel connected to the downhole device and moveable within the housing between at least three stops, each of the three stops defining a different configuration of the device; and a detent mechanism comprising a locking device which is movable relative to the mandrel to engage the mandrel to selectively lock the mandrel in one of the at least three stops within the housing; wherein the locking device comprises at least one dog on one of the mandrel and the locking device that is adapted to engage with a respective groove on the other of the mandrel and the locking device; wherein the locking device is unlocked from the mandrel by the movement of the shuttle device; and wherein a pressure differential is applied via the control line to the shuttle device to activate movement of the shuttle device to engage the locking device and thereby disengage the locking device from the mandrel, allowing the mandrel to move between the at least three stops; wherein the at least one dog on the locking device can be moved into and out of engagement with the mandrel by the movement of the shuttle device.

* * * * *